US008422251B2

(12) United States Patent
Bischoff et al.

(10) Patent No.: US 8,422,251 B2
(45) Date of Patent: Apr. 16, 2013

(54) CIRCUIT ARRANGEMENTS FOR OPERATING A HOUSEHOLD APPLIANCE

(75) Inventors: Martin Bischoff, Falkensee (DE); Lothar Knopp, Berlin (DE); Thomas Ludenia, Falkensee (DE); Guido Sattler, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 545 days.

(21) Appl. No.: 12/745,923

(22) PCT Filed: Nov. 5, 2008

(86) PCT No.: PCT/EP2008/065009

§ 371 (c)(1),
(2), (4) Date: Jun. 3, 2010

(87) PCT Pub. No.: WO2009/071413

PCT Pub. Date: Jun. 11, 2009

(65) Prior Publication Data

US 2010/0251776 A1 Oct. 7, 2010

(30) Foreign Application Priority Data

Dec. 5, 2007 (DE) ..... 10 2007 058 376

(51) Int. Cl.
*H02M 3/335* (2006.01)

(52) U.S. Cl.
USPC ..... 363/21.06; 363/41; 323/266

(58) Field of Classification Search ..... 363/16–20, 363/21.04, 21.06, 21.16, 21.17, 34–41, 49, 363/89, 95, 126, 127; 323/222, 266, 267, 323/271, 282–286, 299, 908, 909; 315/224, 315/247, 291, 307
See application file for complete search history.

(56) References Cited

U.S. PATENT DOCUMENTS

| | | | | |
|---|---|---|---|---|
| 4,180,780 | A * | 12/1979 | Rumbaugh | 330/252 |
| 4,208,890 | A | 6/1980 | Wood | |
| 5,280,423 | A | 1/1994 | Imai et al. | |
| 5,485,122 | A * | 1/1996 | Lorenz | 330/252 |
| 6,483,373 | B1 * | 11/2002 | Lim et al. | 327/525 |
| 7,170,274 | B2 * | 1/2007 | Mukherjee et al. | 323/313 |
| 7,369,386 | B2 * | 5/2008 | Rasmussen et al. | 361/93.9 |

(Continued)

FOREIGN PATENT DOCUMENTS

| | | |
|---|---|---|
| DE | 2358638 | 5/1974 |
| DE | 4140034 A1 | 6/1993 |

(Continued)

*Primary Examiner* — Rajnikant Patel
(74) *Attorney, Agent, or Firm* — James E. Howard; Andre Pallapies

(57) ABSTRACT

A circuit for operating a household appliance, wherein the circuit includes a switched-mode power supply for converting the power supply of a public power supply network into direct supply voltage. The circuit also includes a controller that is connected to the switched-mode power supply for being supplied with the direct supply voltage and for controlling processes of the household appliance. An EMC filter is provided to protect the public supply network from interference signals from the household appliance. The EMC filter includes a condenser that is connected between a phase conductor pole and a neutral conductor pole of the public power supply network; a bleeder resistor that is connected in parallel with the condenser; and a switch that can be activated by the controller to connect the condenser and the bleeder resistor to the neutral conductor pole.

24 Claims, 1 Drawing Sheet

U.S. PATENT DOCUMENTS

| | | | |
|---|---|---|---|
| 7,973,431 | B2 | 7/2011 | Feldmeier |
| 2005/0113980 | A1 | 5/2005 | Albayrak et al. |
| 2009/0049844 | A1 | 2/2009 | Albayrak et al. |

FOREIGN PATENT DOCUMENTS

| | | | |
|---|---|---|---|
| DE | 19713449 | A1 | 10/1998 |
| DE | 20206728 | U1 | 8/2002 |
| DE | 10222108 | A1 | 12/2003 |
| DE | 20214073 | U1 | 3/2004 |
| EP | 0399406 | A2 | 11/1990 |
| EP | 0504545 | B1 | 9/1992 |
| EP | 0775463 | B1 | 4/2001 |
| JP | 59014890 | A | 1/1984 |
| JP | 62016791 | A | 1/1987 |
| JP | 63107456 | A | 5/1988 |
| JP | 02055089 | A | 2/1990 |
| JP | 04105693 | A | 4/1992 |
| JP | 05208099 | A | 8/1993 |
| JP | 2000019211 | A | 1/2000 |
| JP | 2000023479 | A | 1/2000 |
| JP | 2000202190 | A | 7/2000 |
| JP | 2001009189 | A | 1/2001 |
| JP | 2005312174 | A | 11/2005 |

* cited by examiner

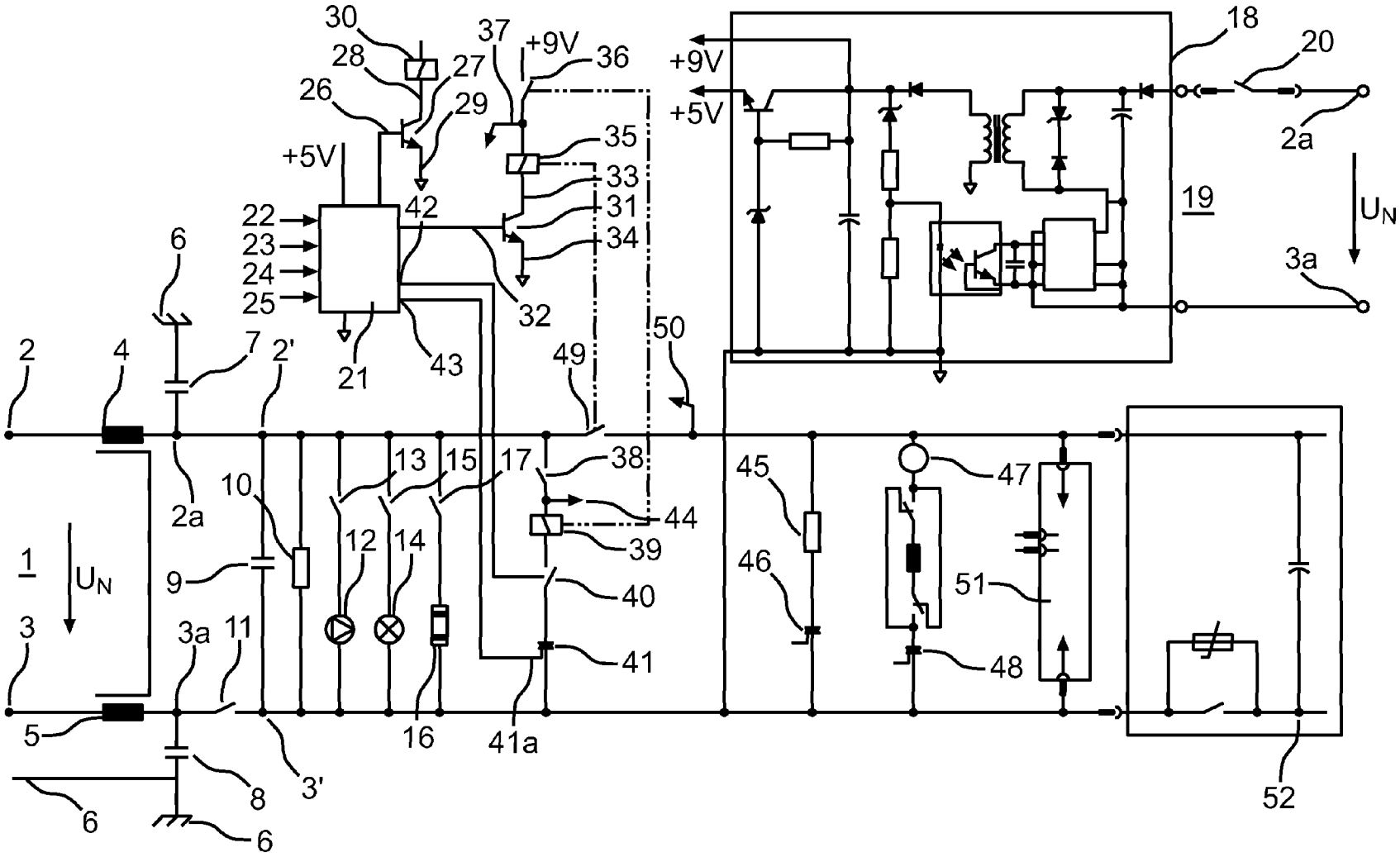
$U_N$
2a
3a
20
18
19
52
47
51
48
45
46
+9V
+5V
50
44
39
40
41
38
49
36
35
33
31
34
32
37
27
29
30
28
26
42
43
21
+5V
22
23
24
25
17
15
13
14
12
16
41a
2'
3'
7
10
9
11
8
6
2a
3a
4
5
2
1
3
$U_N$

CIRCUIT ARRANGEMENTS FOR OPERATING A HOUSEHOLD APPLIANCE

BACKGROUND OF THE INVENTION

The present invention relates to circuit arrangements for operating a household appliance, in particular a household appliance for the care of laundry items.

The term household appliance is understood here to mean in particular an electrical device, preferably with an automatic program flow, which can be used to control the household appliance and which preferably comprises a door, like for instance a washing machine, a dryer, a washer-dryer, a dishwasher or a cooking device.

Circuit arrangements of this type for operating household appliances are already known from the prior art. The known circuit arrangements generally include an EMC mains filter, by means of which the public power supply network is protected against interference signals from the household appliance. EMC stands for electromagnetic compatibility. These are in particular interference signals which develop as a result of the brushes powering a rotor of the household appliance. To prevent the propagation of the interference signals into the public power supply network, the EMC network filter usually has a condenser connecting the network plug poles as well as a bleeder resistor connected in parallel thereto. This is needed in order to bleed residual charges in the condenser and thus to prevent an operating person from receiving an electric shock via the network plug poles when the household appliance is switched off. The need for the high-resistance bleeder resistor is associated here with the disadvantage that a power consumption of approximately 70 mW takes place even when the household appliance is switched off.

Moreover, the known circuit arrangements generally include a switched-mode power supply with a power switch, which are usually arranged in a control panel of the household appliance. The arrangement in particular of the network switch in the control panel results in all machine currents firstly being fed to the control panel and being distributed from there via a suitable module. The EMC filter is therefore arranged directly at the network input of the circuit arrangement.

Nowadays, all actuators, in other words the safety-critical consumers, such as for instance a pump, a valve or a motor, are embodied such that they are connected to the public power supply network when the household appliance is switched on. Activation immediately puts these into operation. This is disadvantageous in that in the event of a possible short-circuit to ground, the safety-critical consumers are switched on, although the household appliance itself is switched off.

Household appliances, such as washing machine, dryers or washer-dryers, generally include an electrical contact element for locking a door. This electrical contact element is nowadays used to ensure that a motor and/or a safety-critical consumer can only be powered when the door is locked. Here the motor current is fed via this door contact, thereby being associated with disadvantages in terms of design of the door catch and the cabling.

BRIEF SUMMARY OF THE INVENTION

The object of the present invention is to provide a circuit arrangement for operating a household appliance, in which measures can be taken, with little effort, which ensure an energy-efficient and consequently safer operation of the household appliance.

A circuit arrangement according to a first aspect of the present invention is embodied to operate a household appliance, in particular a household appliance for the care of laundry items. The circuit arrangement includes a switched-mode power supply for converting a power supply of a public power supply network into a direct supply voltage, having a control unit for controlling processes of the household appliance, which is connected to the switched-mode power supply and can be supplied by the direct supply voltage. The circuit arrangement has an EMC filter for protecting the public power supply network from interference signals from the household appliance, wherein said filter has a condenser connected between a phase conductor pole and a neutral conductor pole of the public power supply network and a bleeder resistor connected in parallel thereto, wherein the condenser and the bleeder resistor can be connected to the neutral conductor pole via a switch which can be activated by the control unit.

This circuit arrangement advantageously achieves the power consumption of 0 watt when the household appliance is switched off. Moreover, this herewith ensures that the power isolation of the household appliance no longer takes place as with conventional household appliances with a mechanical power switch in a control panel but instead via the separate switch, which is arranged close to the EMC filter. The condenser and the associated bleeder resistor can therefore also be arranged downstream of the power isolation, without the effect of the EMC filter being subject to undesired deterioration.

The switched-mode power supply can preferably be connected directly to the neutral conductor pole on the one hand and to the phase conductor pole on the other hand by way of a switched-mode power supply switch. In particular, the switched-mode power supply including the switched-mode power supply switch is connected in parallel to the EMC filter, with it being possible for an operating person of the household appliance in particular to actuate the switched-mode power supply switch. This means that the machine current is not fed, as conventionally, via the control panel.

A household appliance is preferably connected to the public power supply network by means of a plug-in device, for instance by means of a so-called schuko-plug, which has different plug-in possibilities. Rotating the plug-in device enables the neutral conductor pole and the phase conductor pole to be interchanged. Such an interchanging of the poles enables the switched-mode power supply to be connected directly to the phase conductor pole and on the other hand to the neutral conductor pole by way of a switched-mode power supply switch. Furthermore the invention is only described for one plug position, it is however correspondingly also effective for a interchanging of the poles. This means that the phase conductor becomes the neutral conductor and vice versa.

In one embodiment, a pump with a pump switch connected in series thereto are connected in parallel with the condenser and the bleeder resistor, with it being possible to connect the pump to the phase conductor pole of the power supply by means of the pump switch. A heater with a heating switch connected in series thereto is preferably connected in parallel to the condenser and the bleeder resistor, with it being possible to connect the heater to the phase conductor pole of the public power supply network by means of the heating switch. A light source for illuminating the interior of a drum with a light switch connected in series thereto is preferably connected in parallel to the condenser and the bleeder resistor, with it being possible to connect the light source to the phase conductor pole of the public power supply network by means of the light switch. This means that the safety-critical components in particular, such as the pump and the heater, can be separated on both sides from the public power supply network by way of the switch on the one hand and by way of the heating switch and/or pump switch on the other hand.

According to one embodiment, a valve unit having a valve and a triac for controlling the valve is connected in parallel with the condenser and the bleeder resistor, which can be connected to the phase conductor pole by way of a switch. A motor unit with a motor and a triac for controlling the motor is preferably connected in parallel with the condenser and the bleeder resistor, which can be connected to the phase conductor pole by way of a switch. In particular, the motor unit is connected in parallel to the valve unit, with it being possible for the valve unit and the motor unit to be connected to the phase conductor pole by means of a shared switch. This switch can preferably be activated by a control element, which is connected in series with a contact element for locking a door of the household appliance, and can be activated by the control unit when the contact element is closed. The control element is preferably designed for operation using direct current. This advantageously herewith means that the two safety-critical components, the valve unit and the motor unit, are separated from the public power supply network on both sides, by way of the shared switch on the one hand and by way of the switch connecting the condenser and the bleeder resistor with the neutral conductor pole on the other hand. Moreover, this ensures that the motor unit and the valve unit can only then be powered if the door of the household appliance is locked. Nevertheless, this ensures that even when the door is locked, the motor unit and the valve unit are only switched on when necessary. Because the contact element for locking the door is only connected in series with the control element for activating the shared switch, which is designed for operation using direct current, this means that no motor currents are fed via the door catch. With this indirect usage of the contact element for controlling the shared switch, it is possible to optimize the motor wiring loop on the one hand and the door catch on the other hand, without having to accept limitations in terms of safety.

A circuit arrangement according to a second aspect of the present invention is embodied to operate a household appliance, in particular a household appliance for the care of laundry items. The circuit arrangement includes a switched-mode power supply for converting a power supply of a public power supply network into a direct supply voltage, having a control unit for controlling processes of the household appliance, wherein said control unit is connected to the switched-mode power supply and can be supplied by the direct supply voltage and having an electrical contact element for locking a door of the household appliance. A safety-critical electrical consumer for carrying out a process of the household appliance can be connected here to the power supply network by way of an electrical switch, which can be activated by a first control element which is connected in series with the electrical contact element for locking the door, with the first control element being designed for operation using direct current and with it being possible to actuate the first control element by the control unit when the contact element is closed.

Advantageously this switching arrangement, and in particular the serial circuit of the electrical contact element for locking the door with the first control element for activating the electrical switch, which is designed for operation with direct current, means that the safety-critical electrical consumer can be exclusively powered when the household appliance door is locked. Furthermore, this indirect use of the electrical contact element for locking the door also for controlling the electrical switch enables the cable loop of the electrical consumer on the one hand and the door catch on the other hand to be optimized without having to accept restrictions in terms of operational safety. The door catch must therefore be designed exclusively for operation with direct current.

In one embodiment, a second control element, in particular a bipolar transistor or a field effect transistor (FET) is provided, the control connection of which is connected to the control unit, by way of which the current flow to the first control element can be controlled. This herewith ensures that the electrical switch connecting the safety-critical consumer to the public power supply network can be particularly reliably controlled by the control unit of the household appliance. In particular, the field effect transistor ensures a practically loss-free operation of the electrical switch.

The contact element for locking the door can preferably be activated by way of a third control element, which can be activated by the control unit when the door is closed. To the benefit of safety, the third control element, which can be controlled exclusively when the door is closed, ensures that the safety-critical consumer cannot be supplied with energy when the door is open.

The safety-critical electrical consumer is preferably a motor and/or a valve for metering fluid and/or a heater and/or a pump.

A circuit arrangement according to a third aspect of the present invention is embodied for operating a household appliance, in particular a household appliance for the care of laundry items. The circuit arrangement includes a switched-mode power supply for converting a power supply of a public power supply network into a direct supply voltage, having a control unit for controlling processes of the household appliance, wherein said control unit is connected to the switched-mode power supply and can be supplied by the direct supply voltage, and having at least one safety-critical electrical consumer, which is connected to the power supply network at least indirectly. One basic idea is that the at least one safety-critical electrical consumer can be connected to the power supply network on both sides respectively by way of a switch which can be activated by the control unit, with the at least one safety-critical electrical consumer being disconnected from the supply network on both sides when the household appliance is switched-off.

In other words, one fundamental idea is that the at least one safety-critical electrical consumer remains disconnected from both network plug poles, in other words from a phase-conductor pole and a neutral conductor pole, of the power supply network when the household appliance is switched off. A two-sided connection is therefore understood to mean in particular the connection to the network poles, with the consumer also being able to have further signal inputs and signal outputs. The term safety-critical consumer is understood here to mean in particular an electrical consumer, in which the risk of a short-circuit to ground could result in the consumer unintentionally being switched on when the household appliance is switched off. The circuit arrangement advantageously achieves a particularly safe operation of the household appliance. In particular, the household appliance can include a plurality of safety-critical consumers, with, in this case, it being possible for each of the electrical consumers to be connected to the public power supply network on the one hand by way of a switch and on the other hand, in particular to the neutral conductor pole, by way of a shared switch. As a result, a two-stage power supply can be ensured, with it being possible to only supply the safety-relevant component when necessary. The two-pole isolation of the safety-relevant consumer from the public power supply network when the household appliance is switched off ensures that no unwanted power-up of the consumer can take place in the event of a short-circuit to ground when the household appliance is switched off.

At least one safety-critical electrical consumer is preferably a motor and/or a valve and/or a heater and/or a pump of the household appliance.

In one embodiment, the one switch can be activated by a control element, which is connected in series to an electrical contact element for locking a door of the household appliance and can be activated by the control unit when the contact element is in a closed state. The control element is preferably designed for operation using direct current. By means of this series circuit of the control element which can activate the one switch, having the electrical contact element for locking the door, it is possible for the safety-critical electrical consumer to be powered exclusively when the door is locked. Furthermore, the two-sided disconnection of the electrical consumer from the public power supply network ensures that even when the door is locked, the safety-critical consumer is only switched on if required. Because the electrical element for locking the door is an integral part of a control loop for activating the one switch, no machine currents are guided by the contact element. This indirect usage of the contact element for locking the door and also for activating the switch enables an optimization of the cable loop of the electrical consumer on the one hand and of the door catch on the other hand. No restrictions in terms of safety are accepted. In particular, the design of the contact element for operation with direct current enables a component-reduced and cost-reduced design of the door catch.

The contact element for locking the door when the door is closed can preferably be activated by the control unit. This herewith ensures that the door can only be locked by means of the contact element when it is closed.

A further aspect of the invention relates to a method which is designed to operate a household appliance, in particular a household appliance for the care of laundry items, with the aid of a circuit arrangement. Here the circuit arrangement includes a switched-mode power supply for converting a power supply of a public power supply network into a direct supply voltage, having a control unit for controlling processes of the household appliance, wherein said control unit is connected to the switched-mode power supply and can be supplied by the direct supply voltage. An EMC filter protects the public power supply network from interference signals from the household appliance. The EMC filter here has a condenser which is connected between a phase conductor pole and a neutral conductor pole of the power supply network and a bleeder resistor connected in parallel thereto, with the condenser and the bleeder resistor being connected to the neutral conductor pole by way of a switch which can be activated by the control unit.

With a method according to a further aspect of the invention, a household appliance, in particular a household appliance for the care of laundry items, is operated with the aid of a circuit arrangement. Here the circuit arrangement includes a switched-mode power supply for converting a power supply of a public power supply network into a direct supply voltage, having a control unit for controlling processes of the household appliance, wherein said control unit is connected to the switched-mode power supply and can be supplied by the direct supply voltage. Moreover, an electrical contact element is provided for locking a door of the household appliance, with a safety-critical electrical consumer for carrying out a process of the household appliance being connected to the power supply network by way of an electrical switch, which is activated by a first control element which is connected in series with the electrical contact element for locking the door, with the first control element being operated with direct current and, when the contact element is closed, being activated by the control unit.

A method according to a further aspect of the invention is configured to operate a household appliance, in particular a household appliance for the care of laundry items, with the aid of a circuit arrangement. Here the circuit arrangement has a switched-mode power supply for converting a power supply of a public power supply network into a direct supply voltage, having a control unit for controlling processes of the household appliance, wherein said control unit is connected to the switched-mode power supply and can be supplied by the direct supply voltage. At least one safety-critical electrical consumer is at least indirectly connected to the power supply network. Here the at least one safety-critical electrical consumer is connected to the public power supply network on both sides by way of a switch which can be activated by the control unit, with, when the household appliance is in a switched-off state, the at least one safety-critical electrical consumer being disconnected from the public power supply network on both sides.

Advantageous embodiments of the circuit arrangement according to the first, second or third aspect of the invention are to be considered as advantageous embodiments of the circuit arrangements of the other respective aspects of the invention. The same also applies to the circuit arrangements of other aspects of the invention. Advantageous embodiments of the circuit arrangements are to be considered as advantageous embodiments of the method.

BRIEF DESCRIPTION OF THE DRAWINGS

Further advantages, features and details of the invention result from the subsequent description of a preferred exemplary embodiment and on the basis of the drawing.

The sole FIGURE shows a circuit arrangement for operating a household appliance, in particular a household appliance for the care of laundry items, on the basis of which the respective aspects of the invention are explained.

DETAILED DESCRIPTION OF EXEMPLARY EMBODIMENTS OF THE PRESENT INVENTION

The household appliance can be a washing machine, a dryer or a washer-dryer.

The circuit arrangement includes an input 1, which is connected to a power supply network by way of two network plug poles, a phase conductor pole 2, and a neutral conductor pole 3. A power supply $U_N$, in particular 230 V, therefore exists between the phase conductor pole 2 and the neutral conductor pole 3.

The circuit arrangement has an EMC filter arranged on the input 1, which has the task of protecting the public power supply network against interference signals from the household appliance. To this end, the EMC filter has two throttles 4, 5, which connect the phase conductor pole 2 to a phase conductor pole 2*a* on the filter side and/or the neutral conductor pole 3 to a neutral conductor pole 3*a* on the filter side. Furthermore, the EMC filter has a first Y-condenser 7 coupling the phase conductor pole 2 to a protective conductor pole 6 and a second Y-condenser 8 coupling the neutral conductor 3 to the protective conductor pole 6. Moreover, the EMC filter includes a condenser 9 connected in parallel to the input 1 and a bleeder resistor 10 connected in parallel thereto.

The condenser 9 and the bleeder resistor 10 of the EMC filter are connected between a phase conductor pole 2' on the circuit side and a neutral conductor pole 3' on the circuit side. Furthermore, the neutral conductor pole 3' on the circuit side is connected to the neutral conductor pole 3*a* on the filter side by way of an electrical switch 11. This switch 11 enables the condenser 9 and the bleeder resistor 10 of the EMC filter to be connected to the public power supply network.

The circuit arrangement includes a pump 12 with a pump switch 13, which are connected in parallel to the condenser 9 and/or the bleeder resistor 10. Furthermore, a light source 14 for illuminating the interior of the drum of the household appliance with a light switch 15 is likewise arranged in parallel to the bleeder resistor 10 and the condenser 9. Moreover, a heater 16 is provided with a heating switch 17 connected in series thereto, which are connected in parallel with the condenser 9 and the bleeder resistor 10. The heater 10 and the pump 12 are in this instance considered to be safety-critical electrical consumers. It should be noted at this point that all the afore-cited consumers 12, 14, 16 are connected to the respective switches 13, 15, 17 such that the consumers on both sides can be connected to the public power supply network on the one hand by way of the electrical switch 11 and on the other hand by way of the respective switches 13, 15, 17.

The circuit arrangement includes a switched-mode power supply 18, by means of which the power supply $U_N$ is converted into a direct supply voltage, in this case 5 and/or 9 volts. The switched-mode power supply 18 has an input 19, which is connected on the one hand to the phase conductor pole 21 on the filter side by way of a switched-mode power supply switch 20 and on the other hand to the neutral conductor pole 3*a* on the filter side. The switched-mode power supply switch 20 is arranged here in a control panel of the household appliance and can be actuated by an operating person of the household appliance.

Furthermore, the circuit arrangement includes a control unit 21, in particular a microprocessor, which is supplied with the direct supply voltage by the switched-mode power supply 18, currently 5 volts. The control unit 21 is embodied to control processes of the household appliance. The control unit 21 has a DC status input 22 ("Door Closed"), a DL status input 23 ("Door Locked"), an input 24 (L-status input) and an On/Off status input 25. Moreover, the control unit 21 is connected to a control terminal 26 of a transistor 27, with the transistor 27 having two further connecting electrodes 28, 29. If the transistor 27 is controlled by the control unit 21 via the control terminal 26, current flows via the control electrodes 28, 29. The control electrode 28 is also connected to the control element 30 for activating the electrical switch 11. If the connecting electrodes 28, 29 of the transistor 27 are short-circuited, the electrical switch 11 is activated. An activation of the electrical switch 11 arranged on the input 1 is herewith ensured by the control unit 21.

Furthermore, the control unit 21 is connected to a second transistor 31 by way of its control terminal 32. The second transistor 31 includes two further connecting electrodes 33, 34, which are short-circuited when the transistor 21 is activated by the control unit 21 by way of the control terminal 32. The one connecting electrode 33 of the second transistor 21 is connected to an electrical DL contact element 36 for locking a door of the household appliance by way of a control element 35 (L-control element), with the electrical DL contact element 36 on the other hand being connected to the direct supply voltage generated by the switched-mode power supply 18, in this case 9 volts. If the DL contact element 36 for locking the door is closed and the second transistor 31 activated, direct current flows over the control element 35 and the two connecting electrodes 33, 34. To be able to identify the locked state of the door, the DL contact element 36 is connected to the DL status input 23 of the control unit 21 by way of a DL status line 37. If the door is locked, the control unit 21 receives a signal, which is evaluated in respect of the operating level of the DL contact element 36.

The circuit arrangement also includes a DC contact element 38, which is closed when the door is closed. The DC contact element 38 is connected in series with a DL control element 39 for activating the DL contact element 36, with a switch 40 and with a triac 41. It should be noted here that the DC contact element 38, the DL control element 39, the switch 40 and the triac 41 are connected in parallel with the condenser 9 and the bleeder resistor 10. Furthermore, the switch 40 is connected to a DL output 42 of the control unit 21 and the triac 41 via its control electrode 41*a* to the control output 43 of the control unit 21. To be able to identify the closed state of the door, the DC contact element 38 is connected to the DC status input 22 of the control unit 21 via a DC status line 44.

The circuit arrangement also has a valve unit including a valve 45 and a triac 46 as well as a motor unit having a motor 47 and a triac 48. The motor 47 and the valve 45 are in this instance considered as safety-critical consumers. Both the motor unit and also the valve unit are connected in parallel to one another and to the condenser 9 and the bleeder resistor 10, with the two units being connected to the phase conductor pole 2' on the circuit side by way of a switch 49 (L-switch). The switch 49 can be activated here by the control element 35, and can therefore be activated exclusively when the door is locked. To identify the closed state of the switch 49, this is connected to the input 24 of the control unit 21 by way of a conductor 50 (L-status conductor). If the switch 49 is closed, the control unit 21 obtains a signal, which is evaluated in respect of the operational position of the switch 49.

It should be mentioned at this point that the circuit arrangement can also comprise further electrical consumers, such as a heater 51 and/or an operating circuit 52 for a UM/AC motor. The heater 51 can be used in a washer-dryer for instance.

The functionality of the circuit arrangement is described in more detail below. If the switched-mode power supply 20 is closed by an operating person, the power supply $U_N$ is present at the input 19 of the switched-mode power supply 20. The control unit 21 is then supplied with a direct supply voltage, in this case 5 volts. The control unit 21 can now activate the transistor 27 by way of the control terminal 26, so that the electrical switch 11 is closed by means of the control element 30. The electrical switch 11 is embodied in this instance as a relay with the associated control element 30.

It is now possible to switch on the electrical consumer, the pump 12, the light source 14 and the heater 16 according to requirements by way of activating the pump switch 13, the light switch 15 and/or the heater switch 17. The interior of the drum of the household appliance can be illuminated for instance. If the door is closed, the DC contact element 38 closes, which is identified by the control unit 21 by way of the DC status line 44. The switch 40 is then closed by way of the output 42 of the control unit 21 and the triac 41 is activated by way of its control terminal 41*a*. The DL contact element 36 is thus closed to lock the door by way of the associated DL control element 39. The DL contact element 36 with the DL control element 39 are embodied in this instance as a bistable relay. If the DL control element 39 is subjected to a current pulse by way of the triac 41, the DL contact element 36 is closed. The control unit 21 on the DL status unit now receives a signal by way of the DL status line 37, which indicates the closed position of the DL contact element 36.

To be able to start a process of the household appliance, for instance to be able to activate the motor unit and/or the valve unit, the second transistor 31 is now activated by the control unit 21 by way of its control terminal 32. Direct current therefore flows through the terminal electrodes 33, 34 and through the control element 35 and the DL contact element 36 in order to lock the door. The switch 49 is therefore closed, with the control unit 21 then receiving a signal via the input 24 and via the associated line 50, which is evaluated in respect of the operating state of the switch 49. If the switch 49 is closed, the possibility of powering the motor 47 by way of the triac 48 and/or the valve 45 by way of the associated triac 46 is provided.

If the process is terminated, the electrical switch 11 and the switch 49 is opened and all electrical consumers are separated from the public power supply network on both sides.

As the bleeder resistor 10 is disconnected from the public power supply network when the household appliance is switched off, by means of the electrical switch 11, the present circuit arrangement with 0 watt power consumption when switched off is characterized. This is herewith achieved by the power isolation from supply of the household appliance not taking place with a mechanical power switch in the control panel but instead by way of the electrical switch 11 close to the EMC filter. The condenser 9 and the bleeder resistor 10 can therefore be positioned behind the network separator, without inadmissibly negatively affecting the effect of the EMC filter.

Furthermore, all critical components are separated from the public power supply network on both sides when the household appliance is switched off. This herewith ensures that none of the safety-relevant consumers is unintentionally switched on in the event of a short circuit to ground. The arrangement of the individual consumers behind the electrical switch 11 on the one hand and the use of the respective circuit for the power isolation ensures that all electrical consumers also remain separate from the public power supply network when switched off.

The two-stage power supply permits the safety-relevant components to be powered only when necessary. The introduction of the electrical switch 11 ensures that the power supply e.g. of the motor is only switched on when the door is locked. Moreover, power can only be supplied when the door is locked.

With the afore-cited circuit arrangement, an optimized power source of connected power components is achieved. Machine currents are therefore not routed via the control panel, which is ensured by positioning the switched-mode power supply switch 20 directly adjacent to the power input of the household appliance. It is therefore also possible to minimize the machine current-guiding cable loop, according to costs and EMC interferences.

Moreover, the circuit arrangement prevents the motor current from being routed via the door catch. With the indirect use of the DL contact element 36 for controlling the switch 49, it is possible to optimize the motor cable loop on the one hand and the door catch on the other hand, without having to accept restrictions in terms of safety.

The invention claimed is:

1. A circuit for operating a household appliance, the circuit comprising:

a switched-mode power supply for converting a power supply of a public power supply network into a direct supply voltage;

a controller connected to the switched-mode power supply for being supplied with the direct supply voltage and for controlling processes of the household appliance; and an EMC filter for protecting the public supply network from interference signals from the household appliance, the EMC filter comprising:

a condenser connected between a phase conductor pole and a neutral conductor pole of the public power supply network;

a bleeder resistor connected in parallel with the condenser; and a switch activatable by the controller to connect the condenser and the bleeder resistor to the neutral conductor pole.

2. The circuit of claim 1, wherein the household appliance is an appliance for the care of laundry items.

3. The circuit of claim 1, further comprising a switched-mode power supply switch, wherein the switched-mode power supply is selectively connectable to the neutral conductor pole and to the phase conductor pole via the switched-mode power supply switch.

4. The circuit of claim 1, wherein the switch remains in an open switching position when the household appliance is switched off.

5. The circuit of claim 1, further comprising:

a pump connected in parallel to the condenser and the bleeder resistor; and a pump switch connected in series with the pump and in parallel to the condenser and the bleeder resistor, the pump switch for connecting the pump to the phase conductor pole of the public power supply network.

6. The circuit of claim 1, further comprising:

a drum;

a light source for illuminating an interior of the drum; and a light switch connected in series with the light source and in parallel to the condenser and the bleeder resistor and for connecting the light source to the phase conductor pole of the public power supply network.

7. The circuit of claim 1, further comprising:

a heater connected in parallel to the condenser and the bleeder resistor; and a heating switch connected in series with the heater and in parallel to the condenser and the bleeder resistor and for connecting the heater to the phase conductor pole of the public power supply network.

8. The circuit of claim 1, further comprising:

a valve unit having a valve and a triac to control the valve, the valve unit connected in parallel to the condenser and the bleeder resistor; and a valve unit switch to connect the valve unit to the phase conductor pole.

9. The circuit of claim 1, further comprising:

a motor unit having a motor and a triac to control the motor, the motor unit connected in parallel to the condenser and the bleeder resistor; and a motor unit switch to connect the motor unit to the phase conductor pole.

10. The circuit of claim 8, further comprising:

a control element to control the valve unit switch; and a contact element connected in series with the control element, the contact element to lock a door of the household appliance, wherein the control element is controlled by the controller when the contact element is in a closed state.

11. The circuit of claim 10, wherein the control element is configured to operate with direct current.

12. The circuit of claim 1, wherein the phase conductor pole and the neutral conductor pole are interchanged.

13. A circuit for operating a household appliance, the circuit comprising:

a switched-mode power supply for converting a power supply of a public power supply network into a direct supply voltage;

a controller connected to the switched-mode power supply for being supplied with the direct supply voltage and for controlling processes of the household appliance;

an electrical contact element for locking a door of the household appliance;

a safety-critical electrical load;

an electrical switch to connect the safety-critical electrical load to the public power supply network in order to carry out a process of the household appliance; and a first control element connected in series with the electrical contact element for locking the door, the first control element to control the electrical switch; to operate with direct current; and to be controlled by the controller when the electrical contact element is in a closed state.

14. The circuit of claim 13, wherein the household appliance is an appliance for the care of laundry items.

15. The circuit of claim 13, further comprising a second control element having a control terminal connected to the controller, wherein a current flow to the first control element is controlled via the control terminal.

16. The circuit of claim 15, wherein the second control element is a FET.

17. The circuit of claim 13, further comprising a third control element to control the electrical contact element for locking the door of the household appliance, wherein the third control element is controlled by the controller when the door is closed.

18. The circuit of claim 13, wherein the safety-critical electrical load is at least one of a motor, a valve, a heater, and a pump.

19. A circuit for operating a household appliance, the circuit comprising:

a switched-mode power supply for converting a power supply of a public power supply network into a direct supply voltage;

a controller connected to the switched-mode power supply for being supplied with the direct supply voltage and for controlling processes in a household appliance;

at least one safety-critical electrical load that is at least indirectly coupled to the public power supply network; and a switch to connect the at least one safety-critical electrical load to the public power supply network, the switch controlled by the controller;

wherein the at least one safety-critical electrical load is, on both sides, disconnected from the power supply network when the household appliance is switched off.

20. The circuit of claim 16, wherein the household appliance is an appliance for the care of laundry items.

21. The circuit of claim 19, wherein the at least one safety-critical electrical load is at least one of a motor, a valve, a heater, and a pump of the household appliance.

22. The circuit of claim 19, further comprising:

a control element to control the switch; and an electrical contact element for locking a door of the household appliance, the electrical contact element connected in series to the control element;

wherein the control element is controlled by the controller when the electrical contact element is in a closed state.

23. The circuit of claim 22, wherein the control element is configured to operate with direct current.

24. The circuit of claim 22, wherein the controller is configured to control the electrical contact element for locking the door of the household appliance when the door is closed.

* * * * *